US010137687B2

(12) United States Patent
Coventry et al.

(10) Patent No.: US 10,137,687 B2
(45) Date of Patent: Nov. 27, 2018

(54) PRINTING APPARATUS AND METHODS OF PRODUCING SUCH A DEVICE

(71) Applicant: HEWLETT-PACKARD DEVELOPMENT COMPANY, L.P., Houston, TX (US)

(72) Inventors: Laurie A Coventry, Corvallis, OR (US); Rodney L Alley, Corvallis, OR (US); David R Thomas, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/520,711

(22) PCT Filed: Oct. 30, 2014

(86) PCT No.: PCT/US2014/063235

§ 371 (c)(1),
(2) Date: Apr. 20, 2017

(87) PCT Pub. No.: WO2016/068958

PCT Pub. Date: May 6, 2016

(65) Prior Publication Data

US 2017/0305168 A1 Oct. 26, 2017

(51) Int. Cl.
*B41J 2/175* (2006.01)
*B41J 2/14* (2006.01)
*B41J 2/16* (2006.01)

(52) U.S. Cl.
CPC ..... *B41J 2/1601* (2013.01); *B41J 2/14129* (2013.01); *B41J 2/1623* (2013.01);
(Continued)

(58) Field of Classification Search
CPC .. B41J 2/14129; B41J 2/1601; B41J 2/14024; B41J 2/1623; B41J 2202/22
(Continued)

(56) References Cited

U.S. PATENT DOCUMENTS 6,012,804 A 1/2000 Mitani
6,142,611 A 11/2000 Pan
(Continued)

FOREIGN PATENT DOCUMENTS

CN 1232750 A 10/1999
CN 1434770 8/2003
(Continued)

OTHER PUBLICATIONS

Dixon-Warren, et al. Silverbrook Research's technology inside the Memjet Rapid X1 Printer. http.//www.chipworks.com/en/technical-competitive-analysis/resources/blog/silverbrook-researchs-technology-inside-the-memjet-rapid-x1-printer/.

*Primary Examiner* — Huan Tran
*Assistant Examiner* — Alexander D Shenderov
(74) *Attorney, Agent, or Firm* — HP Inc. Patent Department

(57) ABSTRACT

Printing apparatus and methods of producing such a device are disclosed. An example printhead die includes a first resistor (404) to cause fluid to be ejected out of a first nozzle (142; 205; 305) and a second resistor (405) to cause fluid to be ejected out of a second nozzle (142, 205, 305). The example printhead die also includes a first cavitation plate (408) to cover the first resistor (404) and a second cavitation plate (412) to cover the second resistor (405), the first cavitation plate (408) spaced from the second cavitation plate (412).

20 Claims, 7 Drawing Sheets

(52) U.S. Cl.
CPC ..... *B41J 2/1753* (2013.01); *B41J 2/17546* (2013.01); *B41J 2/14024* (2013.01); *B41J 2202/20* (2013.01); *B41J 2202/22* (2013.01)

(58) Field of Classification Search
USPC ..... 347/20
See application file for complete search history.

(56) References Cited

U.S. PATENT DOCUMENTS

| | | | | |
|---|---|---|---|---|
| 6,293,654 | B1 | 9/2001 | Pidwerbecki et al. | |
| 6,929,349 | B2 | 8/2005 | Bell et al. | |
| 2002/0101484 | A1 | 8/2002 | Miller et al. | |
| 2002/0135641 | A1 | 9/2002 | Ozaki et al. | |
| 2003/0231228 | A1 | 12/2003 | Cox et al. | |
| 2004/0017420 | A1* | 1/2004 | Miyamoto | B41J 2/14072 347/20 |
| 2005/0212861 | A1 | 9/2005 | Tsuchii et al. | |
| 2005/0243140 | A1 | 11/2005 | Min et al. | |
| 2006/0055723 | A1 | 3/2006 | Bell et al. | |
| 2009/0066742 | A1 | 3/2009 | Silverbrook et al. | |
| 2009/0141091 | A1 | 6/2009 | Murakami | |
| 2009/0267996 | A1 | 10/2009 | Bell et al. | |
| 2009/0273647 | A1 | 11/2009 | Kwon et al. | |
| 2010/0171793 | A1 | 7/2010 | Jeong | |
| 2010/0220135 | A1 | 9/2010 | Silverbrook | |
| 2012/0298622 | A1 | 11/2012 | White et al. | |
| 2013/0044163 | A1* | 2/2013 | Abbott, Jr. | B41J 2/14129 347/63 |

FOREIGN PATENT DOCUMENTS

| | | | |
|---|---|---|---|
| CN | 102428531 | A | 4/2012 |
| CN | 102656014 | | 9/2012 |
| JP | 2005-306003 | | 11/2005 |
| JP | 2007-269011 | | 10/2007 |
| JP | 2009078395 | A | 4/2009 |

* cited by examiner

PRINTING APPARATUS AND METHODS OF PRODUCING SUCH A DEVICE

BACKGROUND

To print an image onto a print medium in some inkjet printing systems, an inkjet printhead ejects fluid (e.g., ink) droplets through nozzles toward the print medium (e.g., a piece of paper). In some examples, the nozzles are arranged in an array(s) to enable the sequenced ejection of ink from the nozzles to cause characters or other images to be printed on the print medium.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
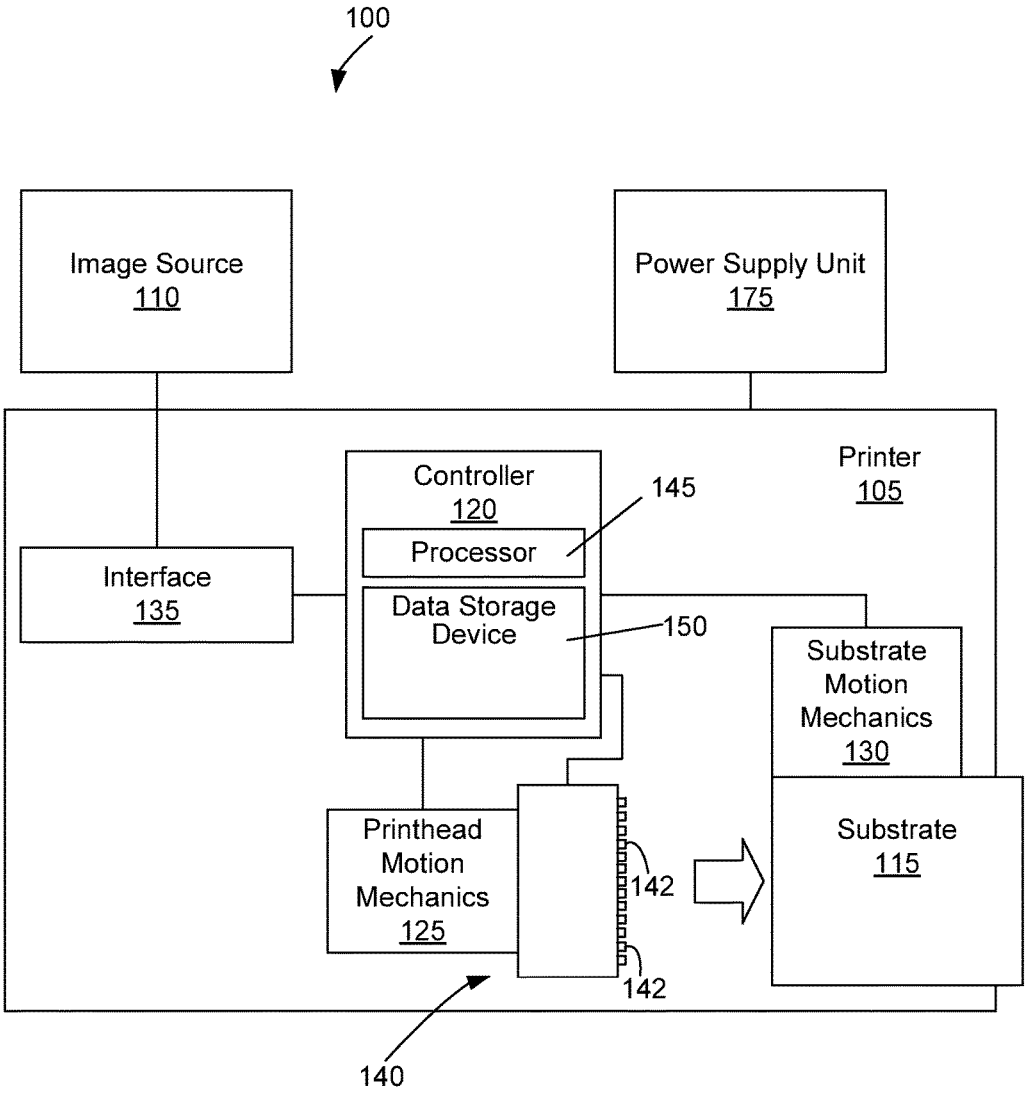
FIG. 1 is a block diagram of an example printing apparatus that can be used to implement the examples disclosed herein.

Some thermal bubble-type inkjet printheads cause droplets of fluid to be ejected from a nozzle by generating heat by passing electrical current through a heating element (e.g., a resistor). In some examples, the current is supplied as a pulse that generates heat and creates a rapidly expanding vapor bubble of fluid (e.g., ink) that forces a small droplet of fluid out of the firing chamber and through the nozzle. When the heating element cools, the vapor bubble quickly collapses drawing more fluid from a reservoir into a firing chamber in preparation for ejecting another droplet from the nozzle.

Because an inkjet ejection process is repeated numerous times per second during printing, the impact caused by collapsing vapor bubbles against the heating element may damage the heating element. In some examples, the repeated collapsing of the vapor bubbles leads to cavitation damage of surface material that coats the heating element. If the surface of the heating element is damaged, ink can penetrate the surface material coating the heating element and contact the hot, high voltage heating element surface causing rapid corrosion and physical destruction of the heating element that prevents the heating element from ejecting fluid (e.g., ink).

In some examples, to reduce the likelihood of cavitation damage, a cavitation plate is formed over multiple heating elements (e.g., resistors) of a printhead array. In some examples, the cavitation plate includes a first layer made of tantalum, a second layer made of platinum and a third layer made of tantalum. In such examples, when a portion of the first layer (e.g., tantalum) covering a first heating element is damaged, fluid ingress and an electrochemical or other type of attack of the second layer (e.g., platinum) may short the cavitation plate and/or the resistor and initiate a cascading effect that damages other portions of the cavitation plate covering other heating elements.

In examples disclosed herein, separate cavitation plates are formed to cover the heating elements, thereby substantially reducing the likelihood of the cascading damage encountered in examples in which a single cavitation plate covers multiple heating elements. In some such examples, a first cavitation plate covers a first heating element (e.g., resistor) and a second cavitation plate, spaced from the first cavitation plate, covers a second heating element (e.g., resistor). The space and/or air gap electronically isolates the first cavitation plate from the second cavitation plate. Thus, if the first cavitation plate is damaged and/or shorted, the second cavitation plate adjacent thereto will not be damaged by the failure of the first cavitation plate. In other examples, a non-conductive material is disposed between the cavitation plates to electronically isolate the cavitation plates. In some examples, the separate cavitation plates include a first layer made of tantalum, a second layer made of platinum and a third layer made of tantalum.

FIG. 1 is a block diagram of an example printing apparatus 100 that can be used to implement the teachings of this disclosure. The example printing apparatus 100 of FIG. 1 includes an example printer 105, an example image source 110 and an example substrate 115 (e.g., paper). The image source 110 may be a computing device from which the printer 105 receives data describing a print job to be executed by an example controller 120 of the printer 105 to print an image on the substrate 115.

In the example of FIG. 1, the printing apparatus 100 also includes printhead motion mechanics 125 and substrate motion mechanics 130. The example printhead and substrate motion mechanics 125, 130 include mechanical devices that move a printhead 140 having a plurality of nozzles 142 and/or the substrate 115, respectively, when printing an image on the substrate 115. According to the illustrated example, instructions to move the printhead 140 and/or the substrate 115 are received and processed by the example controller 120 (e.g., from the image source 110). In some examples, signals may be sent to the printhead 140 and/or the substrate motion mechanics 130 from the controller 120. In examples in which the printing apparatus 100 is implemented as a page-wide array printer, the printhead 140 may be stationary and, thus, the printing apparatus 100 may not include the substrate motion mechanics 130 or the substrate motion mechanics 130 may not be utilized.

The example printer 105 of FIG. 1 includes an interface 135 to interface with the image source 110. The interface 135 may be a wired or wireless connection connecting the printer 105 and the image source 110. The image source 110 may be a computing device from which the printer 105 receives data describing a print job to be executed by the controller 120. In some examples, the interface 135 enables the printer 105 and/or a processor 145 to interface with various hardware elements, such as the image source 110 and/or hardware elements that are external and/or internal to the printer 105. In some examples, the interface 135 interfaces with an input or output device such as, for example, a display device, a mouse, a keyboard, etc. The interface 135 may also provide access to other external devices such as an external storage device, network devices such as, for example, servers, switches, routers, client devices, other types of computing devices and/or combinations thereof.

The example controller 120 includes the example processor 145, including hardware architecture, to retrieve and execute executable code from the example data storage device 150. The executable code may, when executed by the example processor 145, cause the processor 145 to implement at least the functionality of controlling the printhead 140 to print on the example substrate 115 and/or actuate the printhead and/or substrate motion mechanics 125, 130. The executable code may, when executed by the example processor 145, cause the processor 145 to provide instructions to a power supply unit 175, to cause the power supply unit 175 to provide power to the example printhead 140 to eject a fluid from the example nozzle(s) 142.

The data storage device 150 of FIG. 1 stores instructions that are executed by the example processor 145 or other processing devices. The example data storage device 150 may store computer code representing a number of applications, firmware, machine readable instructions, etc. that the example processor 145 executes to implement the examples disclosed herein.

Figure 2:
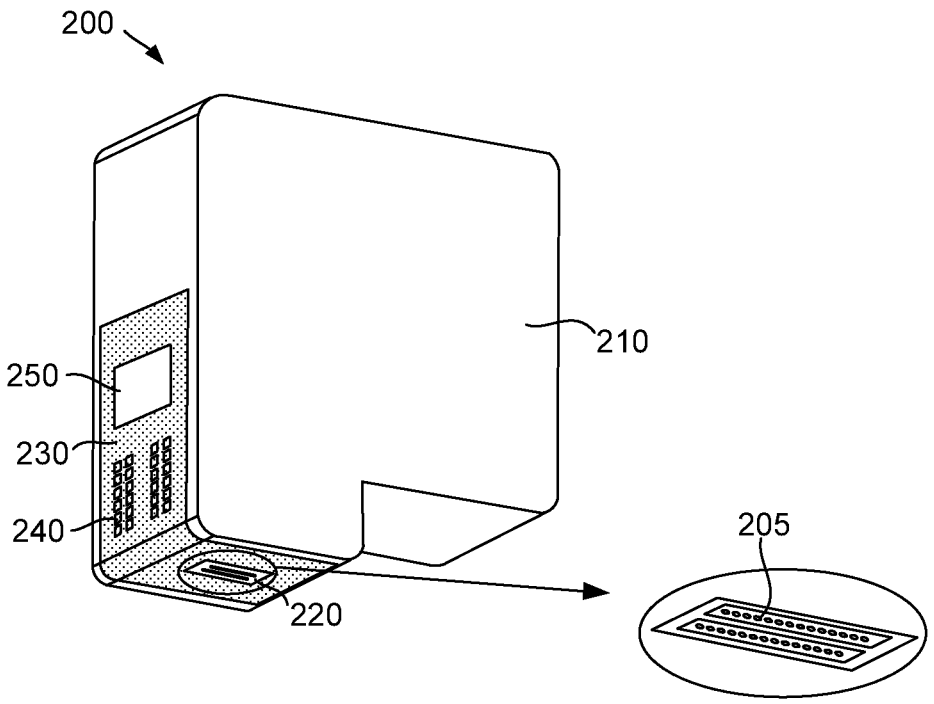
FIG. 2 illustrates an example printing cartridge for use with a printing apparatus that can be used to implement the examples disclosed herein.

FIG. 2 is a block diagram of an example printing cartridge 200 that can be used with the example printing apparatus 100 of FIG. 1. In this example, the printing cartridge 200 includes example nozzles 205, an example fluid reservoir 210, an example die and/or printhead 220, an example flexible cable 230, example conductive pads 240 and an example memory chip 250. The example flexible cable 230 is coupled to the sides of the cartridge 200 and includes traces that couple the example memory 250, the example die 220 and the example conductive pads 240.

In operation, the example cartridge 200 may be installed in a carriage cradle of, for example, the example printer 105 of FIG. 1. When the example cartridge 200 is installed within the carriage cradle, the example conductive pads 240 are pressed against corresponding electrical contacts in the cradle to enable the example printer 105 to communicate with and/or control the electrical functions of the cartridge 200. For example, the example conductive pads 240 enable the printer 105 to access and/or write to the example memory chip 250.

The memory chip 250 of the illustrated example may include a variety of information such as an identification of the type of fluid cartridge, an identification of the kind of fluid contained in the cartridge, an estimate of the amount of fluid remaining in the fluid reservoir 210, calibration data, error information and/or other data. In some examples, the memory chip 250 includes information indicating when the cartridge 200 should receive maintenance. In some examples, the printer 105 can take appropriate action based on the information contained in the memory chip 250, such as notifying the user that the fluid supply is low or altering printing routines to maintain image quality.

To print an image on the substrate 115, the example printer 105 moves the cradle carriage containing the cartridge 200 over the substrate 115. To cause an image to be printed on the substrate 115, the example printer 105 sends electrical signals to the cartridge 200 via the electrical contacts in the carriage cradle. The electrical signals pass through the conductive pads 240 of the cartridge 200 and are routed through the flexible cable 230 to the die 220 to energize individual heating elements (e.g., resistors) within the die 220. The electrical signal passes through one of the heating elements to create a rapidly expanding vapor bubble of fluid that forces a small droplet of fluid out of a firing chamber within the die 220 and through the corresponding nozzle 142 onto the surface of the substrate 115 to form an image on the surface of the substrate 115.

To protect the heating element from impacts caused by collapsing vapor bubbles, in some examples, the die 220 is provided with a cavitation plate that is spaced and/or electronically isolated from an immediately adjacent cavitation plate. Electronically isolating the cavitation plates substantially reduces the likelihood of the cascading damage encountered in examples in which a single cavitation plate covers multiple heating elements. In some examples, the cavitation plates include a first layer made of tantalum (e.g., 500 angstroms of tantalum), a second layer made of platinum (3000 angstroms of platinum) and a third layer made of tantalum (500 angstroms of tantalum).

Figure 3:
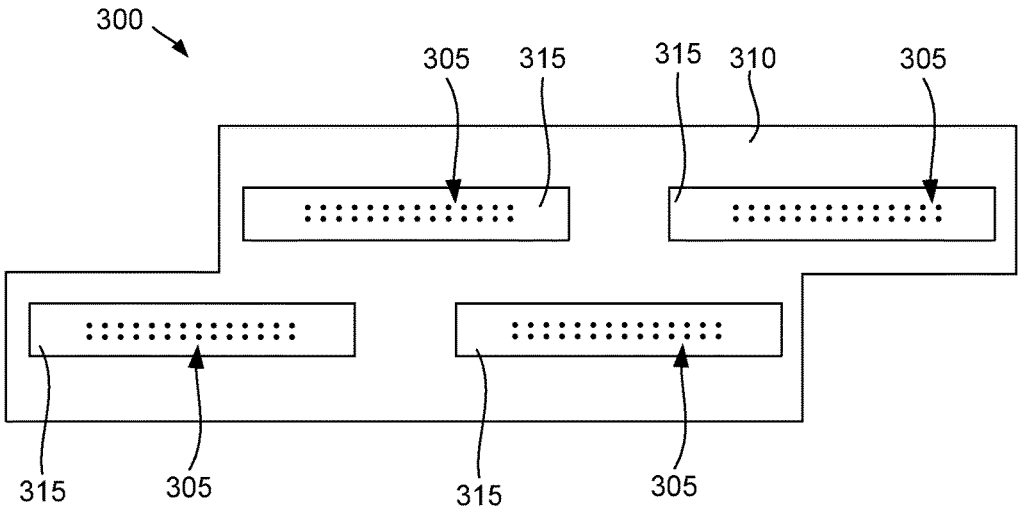
FIG. 3 illustrates an example inkjet array for use with a printing apparatus that can used to implement the examples disclosed herein.

FIG. 3 is a block diagram of an example inkjet array and/or printbar 300 (e.g., a printbar of a web press) that can be used to implement the example printing apparatus 100 of FIG. 1. The example printbar 300 includes a plurality of nozzles 305, a carrier 310 and a plurality of dies 315. The individual nozzles 305 and/or the dies 315 may be communicatively coupled to the controller 120 such that each nozzle is selectively activatable to eject fluid onto the substrate 115. For example, the substrate 115 may be moved past the printbar 300 and heating elements (e.g., resistors) of the nozzles 305 (or other fluid ejection components) may be controlled to eject ink onto the substrate 115 to print an image on the substrate 115. To protect the heating elements from the impact caused by collapsing vapor bubbles, in some examples, the heating elements within the example die 315 have an electronically isolated cavitation plate that substantially reduces the likelihood of the cascading damage.

Figure 4:
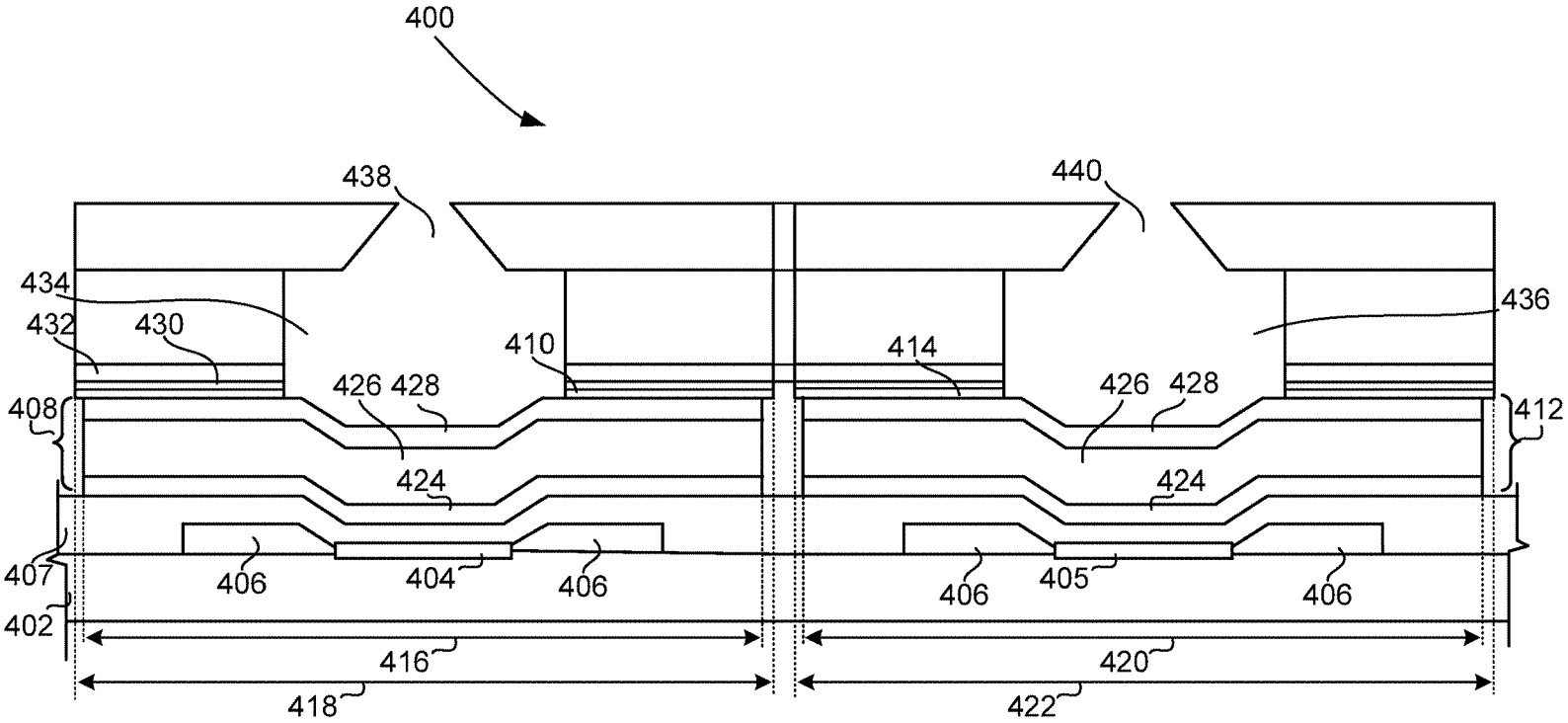
FIG. 4 illustrates a portion of an example die for use with a printing apparatus that can used to implement the examples disclosed herein.

FIG. 4 is a block diagram of an example die and/or printhead 400 that can be used with the printing apparatus 100 of FIG. 1, the example printing cartridge 200 of FIG. 2 and/or the example print bar 300 of FIG. 3. In the illustrated example, the die 400 includes a substrate 402 on which a first heating element and/or resistor 404 and a second heating element and/or resistor 405 are positioned. To provide a charge to the respective resistors 404, 405, conductive material and/or contacts 406 (e.g., aluminum) are provided adjacent the respective ones of the resistors 404, 405. To protect the resistors 404, 405 and/or the conductive material 406 from the environment, an example passivation layer 407 is disposed over the resistors 404, 405 and the conductive material 406.

To reduce the likelihood of cavitation damage to the respective resistors 404, 405, a first cavitation plate 408 is disposed over the first resistor 404 and first adhesive 410 is disposed over the first cavitation plate 408 and a second cavitation plate 412 is disposed over the second resistor 405 and second adhesive 414 is disposed over the second cavitation plate 412. However, in other examples, the adhesive 410, 414 is not provided and/or provided in a different location (e.g., between the resistors 404, 405 and the cavitation plates 408, 412). In this example, the first and second cavitation plates 408, 412 include a first layer 424, a second layer 426 and a third layer 428. In some examples, the first layer 424 is a tantalum layer, the second layer 426 is a platinum layer and the third layer 428 is a tantalum layer. The second layer 426 may be made of platinum because of its resistance to chemical attack and the third layer 428 may be made of tantalum because of its resistance to kogation (e.g., residue build-up).

In some examples, the dimensions of the first cavitation plate 408 and/or the second cavitation plate 412 are approximately 27.5 micrometers by 45 micrometers. In other examples, the dimensions of the first cavitation plate 408 and/or the second cavitation plate 412 are approximately 32.5 micrometers by 125 micrometers. In some examples, a width 418 of the first adhesive 410 is between about 4 and 20 micrometers wider than a width 416 of the first cavitation plate 408. In some examples, the first cavitation plate 408 is spaced between about 10 and 15 micrometers away from the second cavitation plate 412 (e.g., an air gap or other non-conductive material is disposed between the first and second cavitation plates 408, 412). In some examples, a width 422 of the second adhesive 414 is between about 4 and 20 micrometers wider than a width 420 of the second cavitation plate 412.

To protect the cavitation plates 408, 412 and/or the adhesive 410, 414, in this example, first and second protective layers 430, 432 are applied over portions of the cavitation plates 408, 412. In some examples, the first protective layer 430 is silicon nitride and the second protective layer 432 is silicon carbide. in some examples, the first protective layer 430 is silicon carbine and the second protective layer 432 is silicon nitride.

To cause an image to be printed on the substrate 115, the example printer 105 sends electrical signals to the die 400 to energize the respective resistors 404, 405 within the die 220. The electrical signal passes through one of the heating elements 404 to create a rapidly expanding vapor bubble of fluid. The expanding vapor bubble forces a small droplet of fluid out of a respective firing chamber 434, 436 defined by the die 220 and/or a layer(s) thereof and through a corresponding nozzle 438, 440 onto the surface of the substrate 115 to form an image on the surface of the substrate 115.

Figure 5:
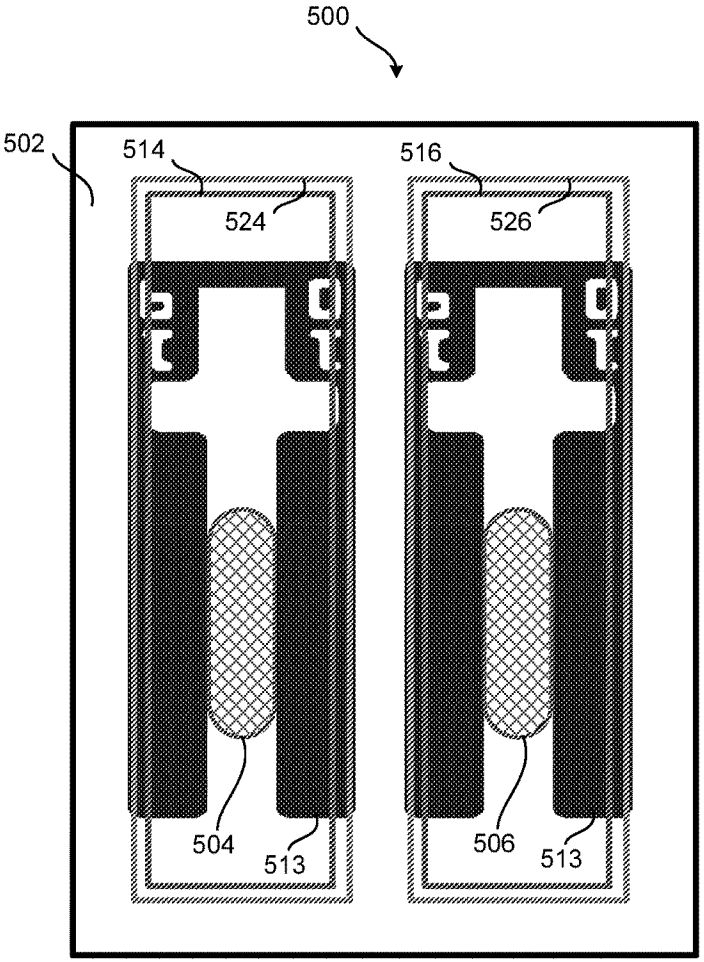
FIG. 5 illustrates a portion of an example die for use with a printing apparatus that can used to implement the examples disclosed herein.

FIG. 5 is a block diagram of an example die and/or printhead 500 that can be used with the printing apparatus 100 of FIG. 1, the example printing cartridge 200 of FIG. 2 and/or the example print bar 300 of FIG. 3. In the illustrated example, the die 500 includes a substrate 502 on which heating elements and/or resistors 504, 506 are positioned. While the die 500 is illustrated as having two resistors 504, 506, the die 500 may alternatively include any number of resistors (e.g., 3, 4, 5, 8, 9, etc.). In some examples, to provide a charge to the resistors 504, 506, conductive material 513 is disposed adjacent the respective resistors 504, 506. In some examples, to protect the resistors 504, 506 and/or the conductive material 513 from the environment, a dielectric passivation layer is disposed over the resistors 504, 506 and/or the conductive material 513. In some examples, the adjacent conductive material 513 are spaced approximately 3.2 micrometers apart.

To reduce the likelihood of cavitation damage to the resistors 404, 405, cavitation plates 514, 516 are disposed over and coupled to the respective ones of the resistors 504, 506. In some examples, adhesive 524, 526 overlies the cavitation plates 504, 506. However, in other examples, the adhesive 524, 526 may not be provided. In some examples, an outer edge of the adhesive 524, 526 is wider by approximately 2 micrometers than an outer edge of the respective one of the cavitation plates 514, 516. However, the outer edge of the adhesive 524, 526 may be disposed in any position relative to the outer edge of the respective one of the cavitation plates 514, 516. In some examples, the adhesives 524, 526 are spaced between about 10 and 15 micrometers apart.

In the illustrated example, the cavitation plates 514, 516 are approximately 32.5 micrometers by 125 micrometers. However, the cavitation plates 514, 516 may be any suitable size to suite a particular application. For example, in some examples, some of the cavitation plates 514, 516 are a first size and some of the cavitation plates 514, 516 are a second size different from the first size. The cavitation plates 514, 516 may include any number of layers such as, for example, three layers where the first layer includes tantalum, the second layer includes platinum and the third layer includes tantalum.

Figure 6:
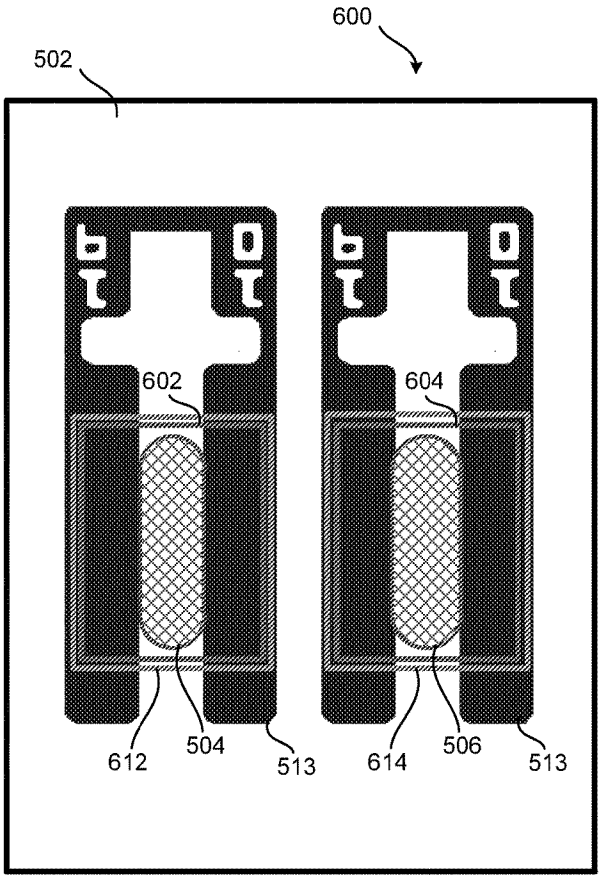
FIG. 6 illustrates a portion of an example die for use with a printing apparatus that can used to implement the examples disclosed herein.

FIG. 6 is a block diagram of an example die and/or printhead 600 that can be used with the printing apparatus 100 of FIG. 1, the example printing cartridge 200 of FIG. 2 and/or the example print bar 300 of FIG. 3. According to the illustrated example, the example die 600 includes sized cavitation plates 602, 604 disposed over and coupled to the respective ones of the resistors 504, 506. In some examples, adhesive 612, 614 overlies the cavitation plates 502, 604. In other examples, the adhesive 612, 614 may not be provided. In the illustrated example, an outer edge of the respective ones of the adhesive 612, 614 is wider by approximately 2 micrometers than an outer edge of the respective ones of the cavitation plates 602, 604. However, the outer edge of the adhesive 612, 614 may be disposed in any position relative to the outer edge of the respective ones of the cavitation plates 602, 604. In some examples, an outer edge of adjacent adhesives 612, 614 is between about 10 and 15 micrometers apart.

The cavitation plate 602, 604 of FIG. 6 are approximately 27.5 micrometers by 45 micrometers. However, the cavitation plate 602, 604 may be any suitable size to suite a particular application. For example, in some examples, some of the cavitation plates 602, 604 are a first size and some of the cavitation plates 602, 604 are a second size different from the first size. The cavitation plates 602, 604 may include any number of layers such as, for example, three layers where the first layer includes tantalum, the second layer includes platinum and the third layer includes tantalum.

Figure 7:
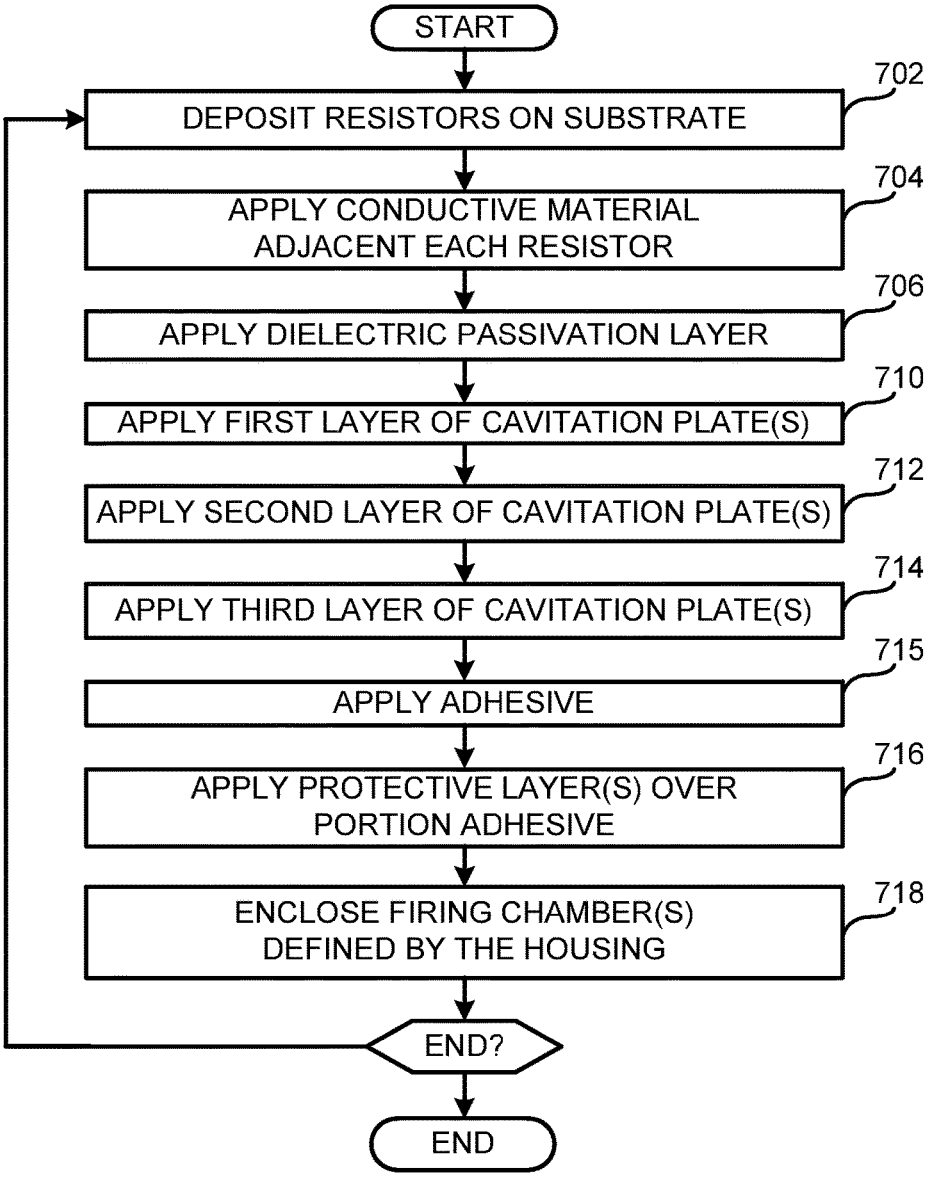
FIG. 7 illustrates an example method of manufacturing an example die as disclosed herein.

FIG. 7 illustrates an example method 700 of manufacturing the example printing cartridge 200 of FIG. 2 and/or the example print bar 300 of FIG. 3 and/or the example die 500 of FIG. 5 and/or the example die 600 of FIG. 6. Although the example method 700 is described with reference to the flow diagram of FIG. 7, other methods of implementing the method 700 may be employed. For example, the order of execution of the blocks may be changed, and/or some of the blocks described may be changed, eliminated, sub-divided and/or combined.

The example method 700 of FIG. 7 begins by depositing and/or forming resistors 404, 405, 504, 506 on the substrate 402, 502 (block 702). To enable current to be provided to the resistors 404, 405, 504, 506, conductive material 406, 503 is formed and/or provided adjacent the respective ones of the resistors 404, 405, 504, 506 (block 704). To protect the resistor 404, 405 and/or conductive material 406 from the environment, the passivation layer 407 is deposited and/or formed over the respective ones of the resistors 404, 405, 504, 506 and the conductive material 406 (block 706).

The first layer 424 of the respective cavitation plates 408, 412, 514, 516, 602, 604 is applied, deposited and/or formed on the passivation layer 408 over the respective resistors 404, 405, 504, 506 (block 710). The second layer 426 is applied and/or deposited over the first layer 424 (block 712). The third layer 428 is applied and/or deposited over the second layer 426 (block 714). The adhesive 410, 524, 526, 612, is then deposited and/or formed over the respective cavitation plates 408, 412, 514, 516, 602, 604 (block 715).

In some examples, the respective ones of the cavitation plates 408, 412, 514, 516, 602, 604 is smaller and/or differently sized than the adhesive 410, 524, 526, 612, 614 that overlies the respective cavitation plate 408, 412, 514, 516, 602, 604. However, in other examples, adhesive 410, 524, 526, 612, 614 may not be provided.

To protect the cavitation plates 408, 412, 514, 516, 602, 604, the first and second protective layers 430, 432 are applied over portions of the respective ones of the cavitation plates 408, 412, 514, 516, 602, 604 and/or the adhesive 410, 524, 526, 612, 614 (block 716). At block 718, the firing chambers 434, 436 are enclosed and/or defined by the housing and/or die 220 and are fluidly coupled to the respective nozzle 438, 440 (block 718). The method 700 then terminates or returns to block 702.

The disclosed examples relate to print dies including electronically isolated cavitation plates to prevent a failure of a first cavitation plate from damaging a second cavitation plate adjacent thereto. In some examples, the cavitation plates are isolated by an air gap. In other examples, the cavitation plates are electronically isolated by disposing a non-conductive material between the cavitation plates. The cavitation plates may include a plurality of layers such as a first layer, a second layer and a third layer.

As set forth herein, an example printhead die includes a first resistor to cause fluid to be ejected out of a first nozzle, a second resistor to cause fluid to be ejected out of a second nozzle, a first cavitation plate to cover the first resistor, a second cavitation plate to cover the second resistor, the first cavitation plate spaced from the second cavitation plate. In some examples, the first cavitation plate includes a first layer, a second layer, and a third layer, the second layer positioned between the first and third layers. In some examples, first layer includes a thickness of approximately 500 angstroms, the second layer includes a thickness of approximately 3000 angstroms, and the third layer includes a thickness of approximately 500 angstroms.

In some examples, the example printhead die include first adhesive to couple the first cavitation plate proximate the first resistor and second adhesive to couple the second cavitation plate proximate the second resistor. In some examples, a first outer edge of the first cavitation plate is inset relative to a second outer edge of the first adhesive. In some examples, a first outer edge of the first cavitation plate is inset approximately 2 micrometers relative to a second outer edge of the first adhesive. In some examples, the example printhead die includes a dielectric passivation layer disposed between the first resistor and the first cavitation plate. In some examples, the printhead die includes a first firing chamber and a second firing chamber, the first firing chamber disposed adjacent the first resistor, the second firing chamber disposed adjacent the second resistor. In some examples, the first resistor and the second resistor are disposed on a substrate. In some examples, the first cavitation plate is spaced approximately 10 micrometers from the second cavitation plate.

An example method includes forming a first resistor and a second resistor on a substrate of a die, forming a first cavitation plate to cover the first resistor and forming a second cavitation plate to cover the second resistor, the first cavitation plate electronically isolated from the second cavitation plate. In some examples, the method includes forming a dielectric passivation layer between the first resistor and the first cavitation plate. In some examples, forming the first cavitation plate includes forming a first layer, a second layer, and a third layer. In some examples, the first layer includes tantalum, the second layer includes platinum, and the third layer includes tantalum.

An example printhead die includes a first resistor to cause fluid to be ejected out of a first nozzle, a second resistor to cause fluid to be ejected out of a second nozzle, a first cavitation plate to cover the first resistor, a second cavitation plate to cover the second resistor, the first cavitation plate electronically isolated from the second cavitation plate.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A printhead die, comprising:

a first resistor to cause fluid to be ejected from a first fluid chamber out of a first nozzle;

a second resistor to cause fluid to be ejected from a second fluid chamber out of a second nozzle;

a first cavitation plate covering the first resistor;

a second cavitation plate covering the second resistor, the first cavitation plate spaced from the second cavitation plate;

a first adhesive layer overlying the first cavitation plate;

a second adhesive layer overlying the second cavitation plate, the first adhesive layer spaced apart from the second adhesive layer; and a protective layer between the first and second fluid chambers and the first and second adhesive layers.

2. The printhead die of claim 1, wherein the first cavitation plate comprises a first layer, a second layer, and a third layer, the second layer positioned between the first and third layers.

3. The printhead die of claim 2, wherein the first layer comprises a thickness of approximately 500 angstroms, the second layer comprises a thickness of approximately 3000 angstroms, and the third layer comprises a thickness of approximately 500 angstroms.

4. The printhead die of claim 1, wherein a first outer edge of the first cavitation plate is inset relative to a second outer edge of the first adhesive layer.

5. The printhead die of claim 1, wherein a first outer edge of the first cavitation plate is inset approximately 2 micrometers relative to a second outer edge of the first adhesive layer.

6. The printhead die of claim 1, further comprising a dielectric passivation layer disposed between the first resistor and the first cavitation plate.

7. The printhead die of claim 1, wherein the first firing chamber is disposed adjacent the first resistor, and the second firing chamber is disposed adjacent the second resistor.

8. The printhead die of claim 1, wherein the first resistor and the second resistor are disposed on a substrate.

9. The printhead die of claim 1, wherein the first cavitation plate is spaced approximately 10 micrometres from the second cavitation plate.

10. The printhead die of claim 1, wherein the first cavitation plate is electrically isolated from the second cavitation plate, and wherein an outer edge of the first adhesive layer extends beyond an outer edge of the first cavitation plate, and an outer edge of the second adhesive layer extends beyond an outer edge of the second cavitation plate.

11. The printhead die of claim 10, wherein each of the first cavitation plate and second cavitation plate has a rectangular shape when viewed from a top of the printhead die, and each of the first adhesive layer and the second adhesive layer plate has a rectangular shape when viewed from a top of the printhead die.

12. The printhead die of claim 1, wherein each of the first cavitation plate and second cavitation plate comprises a tantalum layer, the tantalum layer of the first cavitation plate spaced apart and electrically isolated from the tantalum layer of the second cavitation plate.

13. The printhead die of claim 12, wherein each of the first cavitation plate and second cavitation plate further comprises a platinum layer, the platinum layer of the first cavitation plate spaced apart and electrically isolated from the platinum layer of the second cavitation plate.

14. A method, comprising:

forming a first resistor and a second resistor on a substrate of a die;

forming a first cavitation plate that covers the first resistor;

forming a second cavitation plate that covers the second resistor, the first cavitation plate electronically isolated from the second cavitation plate;

forming a first adhesive layer over the first cavitation plate;

forming a second adhesive layer over the second cavitation plate, the first adhesive layer spaced apart from the second adhesive layer;

forming a protective layer over the first and second adhesive layers; and forming a first fluid chamber to contain fluid to be ejected responsive to activation of the first resistor, the protective layer between the first fluid chamber and the protective layer; and forming a second fluid chamber to contain fluid to be ejected responsive to activation of the second resistor, the protective layer between the second fluid chamber and the protective layer.

15. The method of claim 14, further comprising forming a dielectric passivation layer between the first resistor and the first cavitation plate.

16. The method of claim 14, wherein forming the first cavitation plate comprises forming a first layer, a second layer, and a third layer.

17. The method of claim 16, wherein the first layer comprises tantalum, the second layer comprises platinum, and the third layer comprises tantalum.

18. The method of claim 14, wherein an outer edge of the first adhesive layer extends beyond an outer edge of the first cavitation plate, and an outer edge of the second adhesive layer extends beyond an outer edge of the second cavitation plate.

19. The method of claim 14, wherein each of the first cavitation plate and second cavitation plate has a rectangular shape when viewed from a top of the printhead die, and each of the first adhesive layer and the second adhesive layer plate has a rectangular shape 4 when viewed from a top of the printhead die.

20. A die, comprising:

a first resistor to cause fluid to be ejected from a first fluid chamber out of a first nozzle;

a second resistor to cause fluid to be ejected from a second fluid chamber out of a second nozzle;

a first cavitation plate covering the first resistor;

a second cavitation plate covering the second resistor, the first cavitation plate electronically isolated from the second cavitation plate;

a first adhesive layer overlying the first cavitation plate;

a second adhesive layer overlying the second cavitation plate, the first adhesive layer spaced apart from the second adhesive layer; and a protective layer between the first and second fluid chambers and the first and second adhesive layers.

* * * * *